United States Patent [19]

Kuwashima et al.

[11] Patent Number: 4,792,518

[45] Date of Patent: Dec. 20, 1988

[54] SILVER HALIDE COLOR REVERSAL REFLECTION PRINT SENSITIVE MATERIAL

[75] Inventors: Shigeru Kuwashima; Akio Mitsui; Masaru Sano, all of Kanagawa, Japan

[73] Assignee: Fuji Photo Film Co., Ltd., Kanagawa, Japan

[21] Appl. No.: 186,715

[22] Filed: Apr. 22, 1988

Related U.S. Application Data

[63] Continuation of Ser. No. 37,130, Apr. 10, 1987, which is a continuation of Ser. No. 767,207, Aug. 19, 1985.

[30] Foreign Application Priority Data

Aug. 17, 1984 [JP] Japan ..... 59-172030

[51] Int. Cl.[4] ..... G03C 1/46; G03C 1/08; G03C 1/06; G03C 5/50

[52] U.S. Cl. ..... 430/505; 430/211; 430/212; 430/407; 430/503; 430/506; 430/509; 430/567; 430/569; 430/589; 430/611

[58] Field of Search ..... 430/211, 212, 407, 503, 430/505, 506, 509, 567, 569, 589, 611

[56] References Cited

U.S. PATENT DOCUMENTS

| | | | |
|---|---|---|---|
| 3,271,157 | 9/1966 | McBride | 430/600 |
| 3,505,068 | 4/1970 | Beckett | 430/567 |
| 3,574,628 | 4/1971 | Jones et al. | 430/567 |
| 4,284,717 | 8/1981 | Toya et al. | 430/603 |
| 4,297,439 | 10/1981 | Bergthaller et al. | 430/611 |
| 4,497,895 | 2/1985 | Matsuzaka et al. | 430/567 |
| 4,552,838 | 11/1985 | Wey et al. | 430/567 |

FOREIGN PATENT DOCUMENTS

| | | |
|---|---|---|
| 0149344 | 8/1984 | Japan . |
| 1586412 | 3/1981 | United Kingdom . |

*Primary Examiner*—Mukund J. Shah

*Attorney, Agent, or Firm*—Sughrue, Mion, Zinn, Macpeak, and Seas

[57] ABSTRACT

A silver halide color reversal reflection print photosensitive material comprises at least one blue-sensitive layer, at least one green-sensitive layer and at least one red-sensitive layer on a support. In the characteristic curves of the color sensitive layers, a fluctuation width of point-gammas and absolute values of point-gammas are defined. The distribution of the grain size of the silver halide grains in silver halide emulsions contained in the color sensitive layer can be controlled by forming the grains in the presence of a silver halide solvent.

12 Claims, 2 Drawing Sheets

SILVER HALIDE COLOR REVERSAL REFLECTION PRINT SENSITIVE MATERIAL

This is a continuation of application Ser. No. 037,130, filed Apr. 10, 1987, which is a continuation of application Ser. No. 767,207 filed Aug. 19, 1985.

FIELD OF THE INVENTION

The present invention relates to a silver halide color reversal reflection print photosensitive material and in particular to a silver halide color reversal reflection point photosensitive material that can exhibit excellent tone reproductivity in any case where an original is a transmission original or reflection original.

BACKGROUND OF THE INVENTION

In preparing a color reversal reflection print, the originals can be calssified generally into transmission originals and reflection originals. The transmission originals can be so-called slide photographs and the reflection originals can be color prints, instant photographs, printed materials, etc.

Generally, in producing color reversal reflection prints, depending upon whether the original is a transmission original or a reflection original, there will be a large difference in the exposure range of the color reversal reflection print photosensitive material. That is, in the case of transmission originals, the maximum density of the originals is about 2.8 to 3.3, and to reproduce all the information of the originals, a wide exposure scale is required of the color reversal reflection print photosensitive material; while in the case of reflection originals, since the maximum density is about 1.5 to 2.5, which is lower than that of the transmission originals, a characteristic curve that can provide enough color density in a narrow exposure range is required of the color reversal reflection print photosensitive material.

That means, for example, that if a color reversal reflection print photosensitive material having a wide exposure scale for transmission originals is used for producing a reversal reflection print of a reflection original, the exposure range is too narrow to reproduce enough cntrast of the original, or on the contrary, if a color reversal reflection print photosensitive material having characteristics suitable for reflection originals is used to produce a reversal reflection print of a transmission original, since all the density range of the original is not covered, the information at the high density part or the low density part is lost.

Therefore, in the prior art, as color reversal reflection print photosensitive material use is made of one of two types of photosensitive materials properly depending on whether the original is a transmission original or a reflection original, or a photosensitive material suitable for one of a transmission original and a reflection original is also used for the other original with the insufficient reproducibility of the original being reluctantly accepted, or a halfway photosensitive material having an intermediate characteristic between the characteristics required for both is used.

On the other hand, as for the characteristics of the currently used color reversal reflection print photosensitive materials, the following disadvantages are found.

If the exposure in printing is increased to reproduce the highlight portion such as a white part, for example, a white shirt, a relatively bright portion such as the image of one's face becomes insufficient to be reproduced because the difference in the density of the original is condensed on the print resulting in an image wherein the distinction of the difference in density is hardly recognized and the tone is lost. (The image of the original would not be reproduced on the print.)

In contrast to that, if the printing is effected considering mainly the reproduction of the image of one's face, the part where the color should be white will be developed and an image will result wherein "poor clearing" has occurred. The term "poor clearing" means that the white part has been spoiled.

Conventionally, to improve this "poor clearing", effort has been made to lower Dmin (minimum developed color density), but simple lowering of the Dmin of the characteristic curve would have been apt not to result in its effect in practical printing as expected.

Hitherto, there have been many reports suggesting how to obtain preferable characteristic curves of color photosensitive materials.

For example, to obtain preferable gradation, West German Pat. No. 1,121,470, U.S. Pat. No. 2,688,538, British Pat. No. 813,687, etc., disclose the use of two or more emulsions that are included in two layers separately. British Pat. No. 732,694 describes the use of two or more emulsions in a single layer wherein the emulsions are mixed and the highest sensitive emulsion has a sensitivity at least 8 times higher than the lowest sensitive emulsion. However, although it is expected that the linearity of the characteristic curve would be improved to a certain extent, the reproduction of the tone at the highlight portion is not enough even if these techniques are employed, so that these techniques are satisfactory neither to transmission originals nor reflection originals.

Further, Japanese patent application (OPI) No. 19024/71 (corresponding to U.S. Pat. No. 3,505,068) (the term "OPI" as used herein refers to a "published unexamined Japanese patent application") describes a reversal photosensitive material wherein two emulsions different in sensitivity are used, and a lower sensitive layer is located near the support and the lower sensitive emulsion does not contain AgI in the outer shell. In this patent, since a lower sensitive side emulsion is used so as to reduce the contrast in the lower density region of the reflection image, if this is used as a color reversal reflection print photosensitive material, the reproducibility of the tone at the highlight portion would be deteriorated further. Further, U.S. Pat. No. 4,301,242 describes a method wherein as reversal reflection photosensitive material use is made of two types of emulsions having the same grain size with a narrow distribution whose desensitizing levels are different. In this case, to produce a photosensitive material having a wide exposure scale, the change in the characteristic curve resulting from the treatment using two emulsions of different size is suppressed. The goal is to obtain a reversal reflection print photosensitive material less in the change due to the treatment. Thus, it cannot be said that it has characteristics for providing a good reversible reflection print from either transmission originals or reflection originals.

SUMMARY OF THE INVENTION

An object of the invention is to provide a silver halide color reversal reflection print photosensitive material by which the tone reproducibility can be obtained in any case where transmission originals or reflection originals are used.

A further object of the invention is to provide a silver halide color reversal reflection print photosensitive material improved in the tone reproducibility from the low density region to the high density region.

A still further object of the invention is to provide a silver halide reversal reflection print photosensitive material excellent in the tone reproducibility of a high-light portion and in particular improved substantially in "poor clearing" of a white part.

To attain the above objects, the present invention provides (1) a silver halide color reversal reflection print photosensitive material having at least one blue-sensitive layer, at least one green-sensitive layer and at least one red-sensitive layer on a support, wherein in all the characteristic curves of said color sensitive layers, the fluctuation width of the point-gammas at each of points within the exposure range corresponding to a developed color density of from 1.8 to 0.8 is within ±15% of the average value of the point-gammas in said exposure range, and the absolute value of the point-gamma at each of points within the exposure range corresponding to a developed color density of from 0.3 to 0.2 is 0.3 or more; (2) a silver halide color reversal reflection print photosensitive material as defined in term (1), characterized in that at least one of the color sensitive layrs contains two or more silver halide emulsions, and as a lowest sensitive emulsion of said silver halide emulsions use is made of one in which the grain size of 95% or more of the siliver halide grains falls within the average grain size ±30%, and (3) a silver halide color reversal reflection print photosensitive material as defined in term (1), characterized in that at least one of the color sensitive layers is made up of two or more layers different in sensitivity.

DETAILED DESCRIPTION OF THE INVENTION

Figure 1:
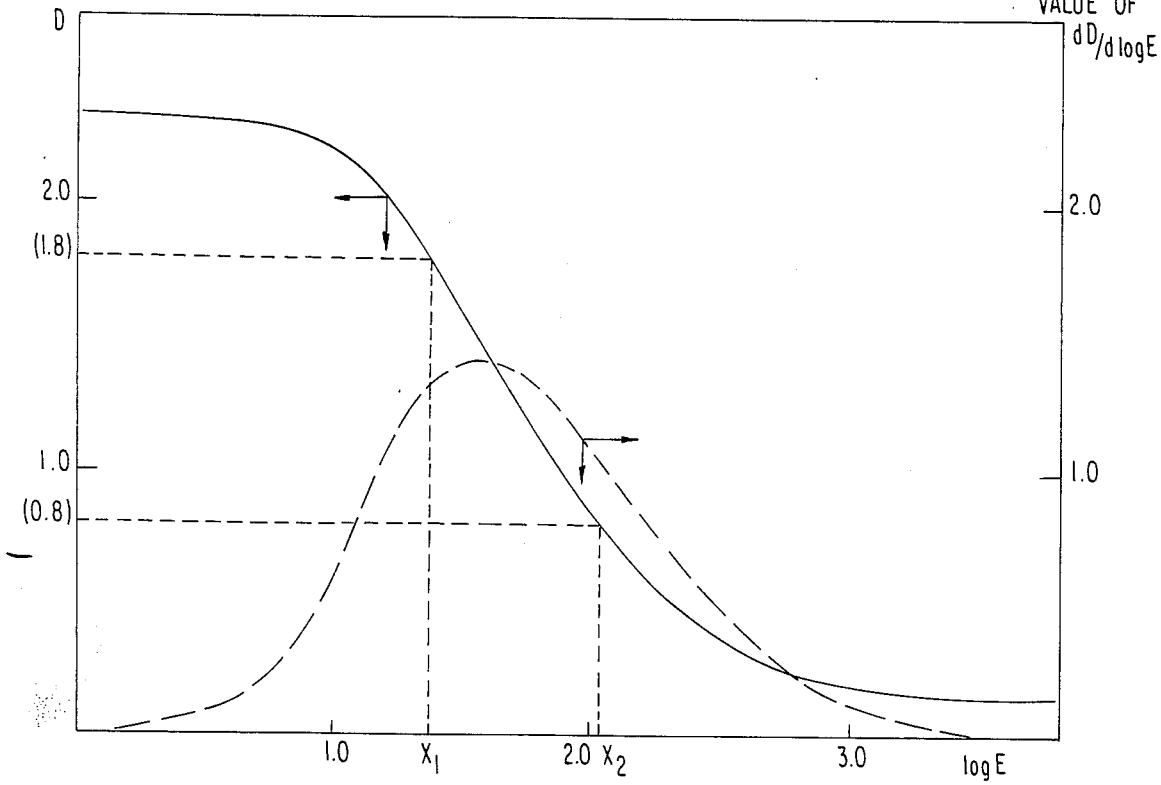
FIG. 1 shows schematic curves of a D-log E curve (solid line) and a dD/d log E-log E curve (broken line) of an example for a silver halide color reversal print photosensitive material.

The term "characteristic curve" used herein refers to the so-called D-log E curve as shown by the solid line graph in FIG. 1 wherein log E (E denotes exposure amount) is plotted along the abscissa and D (D denotes density) is plotted along the ordinate, and is explained in greater detail, for example, in *The Theory of the Photographic Process* by T. H. James, 4th Edition, pages 501–509.

The term "point-gamma" used herein is obtained as follows:

$$\text{point-gamma} = dD/d \log E$$

as defined on page 502 of said publication and denotes a differential value on an arbitrary point on a characteristic curve. The meaning of this value is discussed by R. Luther, *Traus. Faraday Soc.*, 19, page 340 (1923) and L. A. Jones, *J. Franklin Inst.*, 227, pages 297 and 497 (1939).

The broken line graph in FIG. 1 is a dD/d log E-log E curve. As known from this graph, the point-gammas at the exposure ranges corresponding to Dmin and Dmax (maximum density) of the D-log E curve are zero while they have values other than zero at points at the gradation part.

By carrying out the measurement of D (reflection density) as shown below to obtain a D-log E curve, the reflection densities of yellow, magenta and cyan according to the present invention can be obtained independently of each other.

(1) Geological Requirements:

The optical system for measurement of reflection density is constituted such that diffused and reflected light can be measured. That is, a sample is exposed to a light incident on a print with an angle of 45° and light receiving elements are positioned perpendicularly to the sample to receive the light reflected perpendicularly from the surface of the sample.

(2) Spectral Requirements:

Herein, the spectral requirements for the measurements of sensitivity of a color negative film of ISO 5800 are used. That is, as a light source, use is made of a color temperature of 3,200° K., and a monochrometrichromatic density is used that is obtained by using a metal interference filter having absorption peaks at 644 nm, 546 nm, and 436 nm for red, green and blue, respectively.

The "average value of point-gammas" (represented by "$\overline{dD/d \log E}$") can be calculated as follows: as point-gamma is a function of log E, it is assumed that $dD/d \log E = f(\log E)$, and "the average value of point-gammas in the region from a to b (a<b) of log E" is given by $$\overline{dD/d\log E} = \int_a^b f(\log E)\, d\log E/(b-a)$$

The exposure scale used herein can be represented by the difference Δ log E between two log E's where the point-gammas are substantially zero (that is, two log E's values where Dmax and Dmin are given). When an exposure scale is large, the photosensitive material is one that can discriminate over a wide range of light intensity.

The grain size of silver halide is represented by a diameter of a grain when the grain is sphere or approximately sphere and/or can be represented by the length of the arris $\times \sqrt{4/\pi}$ when the grain is cubic, the value of which can be calculated from the projected area of each grain. With reference to the details about measurement of grain size, reference will be made to *The Theory of the Photographic Process*, by C. E. Mees and T. H. James. 3rd Edition, pages 36–43 (1966), published by Macmillan, *The Base of Photographic Engineering* (*Edition of Silver Salts*), edited by Nihon Shashin Gakkai, pages 277–278 (1979), published by Corona Sha, and a report, *The Photographic Journal*, Vol. 79, pages 330–338.

The invention will now be further described in detail.

Two conditions to attain the objects of the invention can be summarized as follows:

(1) To reproduce the tone of the original faithfully and to render the reproducibility excellent in either case of a transmission original and a reflection original, the characteristic curve should be in the shape of a saw instead of an S-shape, that is, the linearity in the intermediate density region of the characteristic curve should be improved.

(2) To obtain the tone reproducibility of both of a highlight (whitened portion) and an intermediate density (the density of one's face, etc.) and to obtain excellent tone reproducibility of a shadow portion in either case of a transmission original or a reflection original, the so-called "sharp cutting at the toe" of the characteristic curve should be made better.

The intermediate density region of a characteristic curve refers to a density in the range of 1.8 to 0.8. In the region where the density is higher than this, an effect of flaring or the like is taken into consideration and a point-gamma higher than that of the intermediate density region may be accepted. A nearly straight line is preferred even if the density is in a lower region than that, but to obtain a complete straight line is difficult in the present state of art, and the inventors have found that by defining point-gammas in an exposure range corresponding to a developed color density of from 0.3 to 0.2, a very satisfactory print can be obtained.

The criterion of the linearity is such that the value of point-gammas in said region is within an average value of the point-gammas within said region ±15%. Outside of this range, the reproduction of the original becomes difficult.

This is shown on the characteristic curve and the dD/log E-log E curve as in FIG. 1, wherein $x_1$ and $x_2$ represents log E's required to give density (D)=1.8 and 0.8, and the values of the points on the dD/log E-log E curve within the exposure range from $x_1$ to $x_2$ are required to be within the average value of the point-gammas by ±15%.

The gradation reproducibility both at a highlight portion and an intermediate density portion can be attained by the so-called "sharp cutting at the toe" of the characteristic curve. This can be attained by keeping the point-gamma at the highlight portion as large as possible to the exposure range corresponding to the low density. Ideally, although it is preferable that the dD/d log E-log E curve is discontinuous at an exposure range corresponding to Dmin from the other exposure range, this object can be attained substantially when the absolute values of the point-grammas at points within the exposure range corresponding to a developed color density of 0.3 to 2.0 is 0.3 or more as defined according to the present invention.

These requirements have been attained by using two or more silver halide emulsions in the same color sensitive layer and as the lowest sensitive layer a monodisperse emulsion is used wherein the grain size of 95% or more of the silver halide grains is within an average grain size ±30%. The lowest sensitive emulsion herein refers to an emulsion having the lowest sensitivity of the constituent emulsions substantially attributing to the characteristic curve, and if, for example, for other purposes a non-after-ripened emulsion or an emulsion very low in sensitivity is used in the same sensitive layer, these should not be counted. To obtain the linearity essential to the present invention, it is desirable to combine plural emulsions different in sensitivity, but to attain the sharp cutting at the toe mentioned in term (2), it is essential to use a monodisperse emulsion, and in the present invention, to attain the objects of the present invention, it is a very important point to what extent the toe should be cut.

The silver halide emulsion characterized in that the grain size of 95% or over of the siliver halide grains is within an average grain size ±30% can be, for example, prepared as follows.

One of the methods is to use a controlled double jet method, wherein when a soluble silver salt and a soluble halide are reacted, a simultaneous mixing process is used to keep the pAg in the liquid phase constant in which silver halide is produced. According to this method, depending on the value of pAg that is kept constant, required regular configuration of crystals can be obtained and the grain size distribution of the present invention wherein the grain size is uniform (monodipsersion) can be attained.

Another effective method of attaining the above silver halide grain size distribution of the present invention is to use a silver halide solvent when grains are formed. For example, ammonia, potassium thiocyanate, ammonium thiocyanate, thioether compounds (see U.S. Pat. Nos. 3,271,157, 3,574,628, 3,704,130, 4,297,439 and 4,276,374, etc.), thione compounds (see Japanese patent application (OPI) Nos. 144319/78, 82408/78 and 77747/80, etc.), amine compounds (see Japanese patent application (OPI) No. 100717/79, etc.), etc., can be preferably used.

To attain the objects of the present invention, silver halide solvents preferably used among others are a compound (tetra-substituted thiourea compound) represented by the following formula (I), a compound (organic thioether compound) represented by the following formula (IIA) or (IIB), and a compound represented by the following formula (III).

The tetra-substituted thiourea silver halide solvent preferably used in the present invention has the following general formula (I):

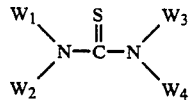

(I)

wherein $W_1$, $W_2$, $W_3$ and $W_4$ may be the same or different and each represents a substituted or unsubstituted alkyl group ($C_1$–$C_{10}$ alkyl group, preferably $C_1$–$C_5$ alkyl group), an alkenyl group (such as an allyl group) or a substituted or unsubstituted aryl group, and the sum of the carbon atoms of $W_1$, $W_2$, $W_3$ and $W_4$ is preferably up to 30, which alkyl group may be linear or branched, or $W_2$ and $W_3$ may be combined to form a 5- or 6-membered heterocyclic ring (such as imidazolidine thione, piperidine, morpholine, etc.), or $W_1$ and $W_2$ or $W_3$ and $W_4$ may be combined to form a 5- or 6-membered heterocyclic ring (such as imidazolidine thione, piperidine, morpholine, benzoselenazole, piperazine, pyrrolidine, etc., and these heterocyclic rings may be substituted with a hydroxyl group).

Representative examples of the alkyl group are a methyl group, an ethyl group, an isobutyl group, a cyclohexyl group and a tert-amyl group. Substituents for the alkyl group include an alkoxy group (preferably 1 to 5 carbon atoms, e.g., a methoxy group, an ethoxy group, and a propoxy group), a hydroxyl group, a cyano group, an amino group, a sulfonyl group, a sulfonic acid group, a carboxyl group, a halogen atom (e.g., chlorine, bromine, fluorine and iodine), an aryl group (e.g., a phenyl group, a halogen-substituted phenyl group, and an alkyl-substituted phenyl group), a 5- or 6-membered heterocyclic ring (e.g., furan, etc.) and the like. Representative examples of such substituted alkyl groups are a 3-methoxypropyl group, a hydroxyethyl group, a cyanoethyl group, a 4-chlorocyclohexyl group, a benzyl group and a carboxyamyl group.

The aryl group includes a phenyl group and a substituted phenyl group. Substituents for the substituted phenyl group include an alkyl group (e.g., a methyl group and an ethyl group), an alkoxyl group (e.g., a methoxy group and an ethoxy group), a cyano group, a hydroxyl group, a carboxyl group, a nitro group, a sulfonyl group, a sulfonic acid group, a halogen atom (e.g., chlorine, bromine, fluorine and iodine), and the like. Representative examples of such substituted phenyl groups include a hydroxyphenyl group, a carboxyphenyl group, a sulfophenyl group, a p-tolyl group, a p-methoxyphenyl group and a p-chlorophenyl group.

Particularly preferably, of $W_1$, $W_2$, $W_3$ and $W_4$, three or more are alkyl groups each having 1 to 5 carbon atoms, the aryl group is a phenyl group, and the sum of the carbon atoms of $W_1$, $W_2$, $W_3$ and $W_4$ is up to 20.

Examples of the compounds that can be used in the present invention are as follows:

I-1

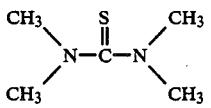

I-2

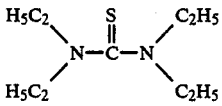

I-3

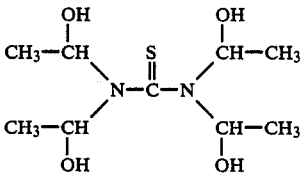

I-4

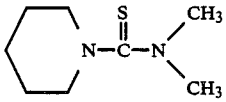

I-5

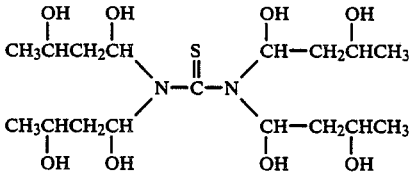

I-6

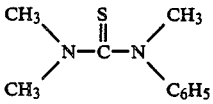

I-7

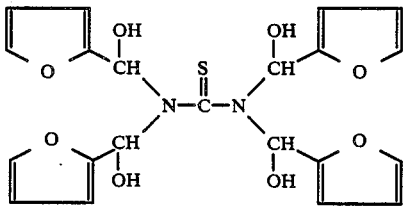

-continued

I-8

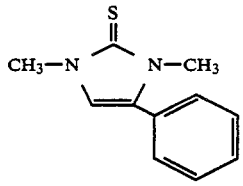

I-9

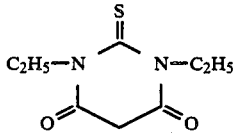

I-10

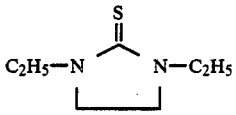

I-11

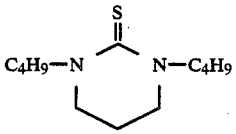

I-12

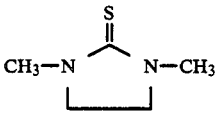

Organic thioether compounds that can be used in the present invention are preferably compounds represented by the following general formula (IIA) or (IIB):

$$Q-[(CH_2)_r-CH_2-S-(CH_2)_2-X'-(R)_p-(CH_2)_2-(R')_q-S-CH_2-(CH_2)_m-Z']_n \quad \text{(IIA)}$$

$$Q-(CH_2)_m-CH_2-S-(CH_2)_n-S-CH_2-(CH_2)_r-Z' \quad \text{(IIB)}$$

wherein r and m are independently 0 or an integer of from 1 to 4; n is an integer of from 1 to 4; p and q are independently 0 or an integer of from 1 to 3; X' represents an oxygen atom, a sulfur atom, $$-\overset{O}{\overset{\|}{C}}NH-,\ -\overset{O}{\overset{\|}{C}}-\ \text{or}\ -\overset{O}{\overset{\|}{C}}-O-;$$

R and R' represent independently a $-CH_2-CH_2-O-$ or $-O-CH_2-CH_2-$ group; and Q and Z' represent independently $$-\overset{O}{\overset{\|}{C}}NH_2,\ -OR''\ \text{or}\ -\overset{O}{\overset{\|}{C}}-OR''$$

wherein R'' represents a hydrogen atom or an alkyl group having 1 to 5 carbon atoms, or Q and Z' may represent together a substituent represented by X' defined above to form a cyclic compound.

More preferred compounds among the compounds represented by the general formula (IIA) or (IIB) are represented by the following general formulae (IIC) to (IIH):

$$HO-R^3-(S-R^5)_r-S-R^3-OH \quad \text{(IIC)}$$

$$(HO-R^3-S-R^3-O-R^5-)_2 \quad \text{(IID)}$$

-continued $$(R^4-O-R^3-S-R^3-\overset{\overset{O}{\|}}{C}-NH-R^5-)_2 \quad \text{(IIE)}$$

$$(R^4-O-R^3-S-R^3-)_2S \quad \text{(IIF)}$$

$$(R^4-NH-\overset{\overset{O}{\|}}{C}-R^3-S-R^3-)_2O \quad \text{(IIG)}$$

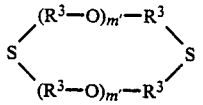

(IIH)

wherein r' represents 0 or an integer of from 1 to 3; m' represents an integer of 1 or 2; $R^3$ and $R^5$ each represents an alkylene group having 1 to 5 carbon atoms (such as a methylene group and an ethylene group); and $R^4$ represents an alkyl group having 1 to 5 carbon atoms (such as an ethyl group).

In the present invention, examples of organic thioether compounds that are preferably used are:

$$HO(CH_2)_2-S-(CH_2)_2-S-(CH_2)_2OH \quad \text{II-1.}$$

$$HO(CH_2)_3-S-(CH_2)_2-S-(CH_2)_3OH \quad \text{II-2.}$$

$$HO(CH_2)_2-S-(CH_2)_2-S-(CH_2)_2-S-(CH_2)_2OH \quad \text{II-3.}$$

$$[HO-(CH_2)_2-S-(CH_2)_2O-CH_2-]_2 \quad \text{II-4.}$$

$$[HO-(CH_2)_5-S-(CH_2)_5O-(CH_2)_2-]_2 \quad \text{II-5.}$$

$$[H_5C_2-O-(CH_2)_2-S-(CH_2)_2-]_2S \quad \text{II-6.}$$

$$[H_3C-O-(CH_2)_4-S-(CH_2)_4-]_2S \quad \text{II-7.}$$

$$[H_3C-NH-\overset{\overset{O}{\|}}{C}-(CH_2)_2-S-(CH_2)_2-]_2O \quad \text{II-8.}$$

$$[H_5C_2-NH-\overset{\overset{O}{\|}}{C}-(CH_2)_3-S-(CH_2)_3-]_2O \quad \text{II-9.}$$

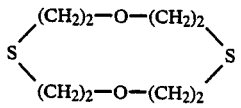

II-10

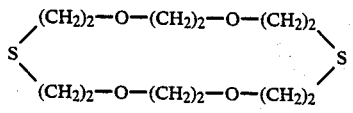

II-11.

$$[NH_2CO(CH_2)_2-S-(CH_2)_2CONH-CH_2-]_2 \quad \text{II-12.}$$

$$HOOC-CH_2-S-(CH_2)_2-S-CH_2-COOH \quad \text{II-13.}$$

$$HOCH_2\underset{\underset{OH}{|}}{C}HCH_2-S-CH_2CH_2-S-CH_2\underset{\underset{OH}{|}}{C}HCH_2OH \quad \text{II-14.}$$

$$[H_3C-O-(CH_2)_2-S-(CH_2)_2-\overset{\overset{O}{\|}}{C}-NH-CH_2-]_2 \quad \text{II-15.}$$

Preferable silver halide solvents that are used in the present invention have the following general formula (III):

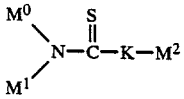

(III)

wherein K represents a sulfur atom or an oxygen atom; $M^0$ and $M^1$ may be the same or different and each represents an aliphatic group (such as an alkyl group having 1 to 4 carbon atoms that may not be substituted or may be substituted by a substituent such as a carboxyl group, a sulfo group, a hydroxy group, an aryl group (preferably a phenyl group), etc., and in particular, a methyl group, an ethyl group, a propyl group, a butyl group, a carboxymethyl group, a carboxyethyl group, a carboxypropyl group, a sulfoethyl group, a sulfopropyl group, a sulfobutyl group, a hydroxyethyl group, a benzyl group, a phenethyl group, etc.), an aryl group (such as an aryl group (preferably a phenyl group) that may not be substituted or may be substituted by an alkyl group (preferably an alkyl group having 1 to 4 carbon atoms), a sulfo group, an alkoxy group (preferably an alkoxy group having 1 to 4 carbon atoms in the alkyl moiety), or a halogen atom, and more particularly a phenyl group, a 2-methylphenyl group, a 4-sulfophenyl group, a 4-ethoxyphenyl group, a 4-chlorophenyl group, etc.), a heterocyclic ring residue (such as a 5- or 6-membered nitrogen-containing ring residue, and more particularly, for example, a 2-pyridyl group, a 3-pyridyl group, a 4-pyridyl group, etc.), or an amino group (preferably a substituted amino group, for example, an arylamino group (the aryl group being preferably an unsubstituted phenyl group or a phenyl group substituted by an alkyl group, a sulfo group, a carboxyl group, etc.), etc., and further more particularly, a 4-sulfophenylamino group, etc.); $M^0$ and $M^1$ may be combined together to form a 5- or 6-membered heterocyclic ring (such as a piperidine ring, a morpholine ring, a piperazine ring, etc.); $M^2$ represents an aliphatic group (such as an alkyl group having 1 to 4 carbon atoms that may not be substituted or may be substituted by a substituent such as a carboxyl group, a sulfo group, a hydroxy group, an aryl group (such as a phenyl group), etc., and more particularly a methyl group, an ethyl group, a propyl group, a butyl group, a carboxymethyl group, a carboxyethyl group, a carboxypropyl group, a sulfoethyl group, a sulfopropyl group, a sulfobutyl group, a hydroxyethyl group, a benzyl group, a phenethyl group, etc.), an aryl group (such as an aryl group (preferably a phenyl group) that may not be or may be substituted by an alkyl group (preferably an alkyl group having 1 to 4 carbon atoms), a sulfo group, an alkoxy group (preferably an alkoxy group having 1 to 4 carbon atoms in the alkyl moiety), a halogen atom or the like, and more preferably a phenyl group, a 2-methylphenyl group, a 4-sulfophenyl group, a 4-ethoxyphenyl group, a 4-chlorophenyl group, etc.); and $M^1$ and $M^2$ may be combined together to form a 5- or 6-membered heterocyclic ring (see, general formula (III') hereinbelow).

A compound represented by the general formula (III') formed by combining $M^1$ and $M^2$ as mentioned above is a more preferable silver halide solvent.

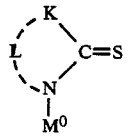

(III')

wherein L represents a group of atoms required to complete a heterocyclic ring (including a condensed ring with an unsaturated 5 or 6 carbon atom rings (such as benzene rings) or tetrahydrobenzene rings, etc.), and K and $M^0$ have the same meaning as defined for the formula (III).

The following examples can be mentioned as silver halide solvents of the general formula (III):
III-1
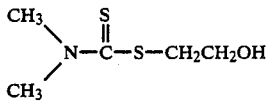
III-2
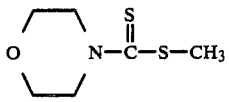
III-3
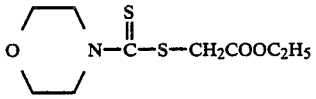
III-4
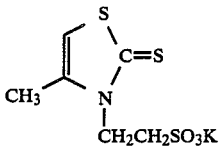
III-5
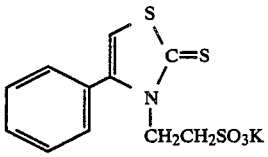
III-6
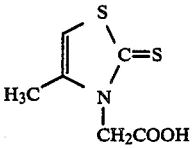
III-7
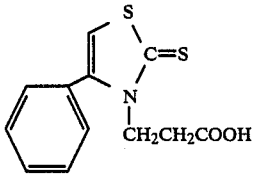
III-8
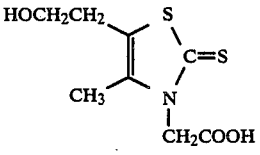
III-9
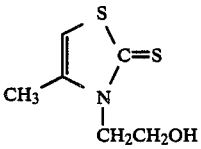
III-10
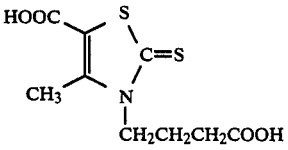
-continued
III-11
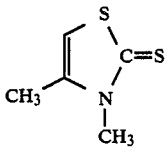
III-12
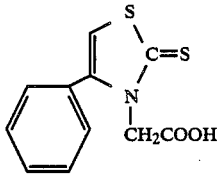
III-13
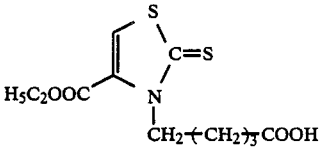
III-14
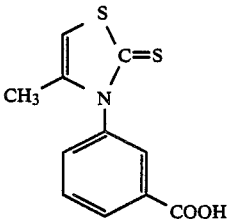
III-15
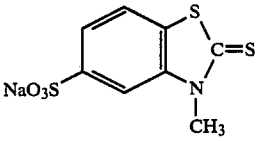
III-16
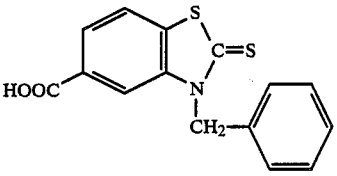
III-17
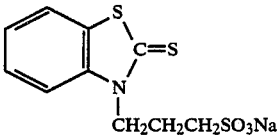
III-18
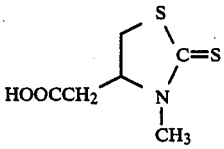
III-19
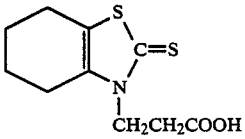
The amount of the silver halide solvent used in the present invention can be varied within a wide range according to the desired effect, the properties of the compound to be used, and the like. Generally the amount will be $10^{-5}$ to $2.5\times10^{-2}$ mol per mol of silver halide.

In the present invention, a silver halide solvent is added in at least one of the step of forming a precipitate of silver halide grains and the step of physical ripening that follows said step in the preparation of an emulsion.

Of the above silver halide solvents, tetrasubstituted thioureas represented by the general formula (I) are particularly suitable for the objects of the present invention.

In the present invention, the maximum developed color density (Dmax) in each layer is preferably 2.1 or more (for any of yellow, magenta and cyan density).

Further, in the present invention, the minimum developed color density in each layer is preferably as low as possible, and in particular, the lowest developed color density of yellow is preferably 0.15 or less.

In the preparation of the silver halide emulsions used in the present invention, a cadmium salt, zinc salt, lead salt, thallium salt, iridium salt or its complex salt, rhodium salts or its complex salt, or iron salt or its complex salt may be present in the course of forming silver halide grains or the course of physical ripening.

The photographic emulsion layer of the photosensitive material used in the present invention may use as a silver halide any one silver bromide, silver bromoiodide, silver bromochloroiodide, silver chlorobromide and silver chloride. A preferred silver halide is silver bromoiodide containing up to 15% by mol of silver iodide. A particularly preferred one is silver bromoiodide containing 2 to 12% by mol of silver iodide.

The average grain size of silver halide grains (in terms of the diameter in the case where the grains are globular or nearly globular, or the arris length in the case where the grains are cubic and that is expressed as an average based on the projected area) is not critical but is preferably up to 3 $\mu$m.

The silver halide grains in the photographic emulsion may be regular crystals, for example, in a cubic or octahedral shape, or irregular crystals, for example, in a globular or tabular shape, or crystals in a shape of a combination of these. The silver halide grains may be mixtures of crystals of these various shapes.

An emulsion may be used wherein ultra tabular silver halide grains whose grain diameter has 5 times or more as large as the thickness occupy down to 50% of the projected area.

A silver halide photographic emulsion which can be used in the present invention can be manufactured according to a method as disclosed in, for example, *Research Disclosure,* No. 17643 (December, 1978), pages 22 and 23, "I Emulsion Preparation and Types" and No. 18716 (November, 1979), page 648.

In the present invention, the order of the sensitive layers can be arbitrarily selected as required. Generally, the red-sensitive emulsion layer contains a cyan forming coupler, the green-sensitive emulsion layer contains a magenta forming coupler and the blue-sensitive emulsion layer contains a yellow forming coupler, but in some cases other combinations are possible.

In the same photographic emulsion layer of the photographic sensitive material produced according to the present invention, another photographic emulsion layer or a nonsensitive layer, is used a dye forming coupler, that is, a compound that can develop color due to the oxidation coupling with an aromatic primary amine developer (such as phenylenediamine derivatives, aminophenol derivatives, etc.) in a color development treatment. For example, as magenta couplers can be mentioned 5-pyrazolone coupler, pyrazolobenzimidazole coupler, pyrazolotriazole coupler, pyrazoloimidazole coupler, pyrazolopyrazole coupler, pyrazolotriazole coupler, pyrazolotetrazole coupler, cyanoacetylcumarone coupler, open chain acylacetonitrile coupler, etc., as yellow couplers can be mentioned acylacetamide couplers (e.g., benzoyl acetanilides, pivaloylacetanilides, etc.), etc., and as cyan couplers can be mentioned a naphthol coupler, a phenol coupler, etc. These couplers are desirably nondiffusible ones having a hydrophobic group called a ballast group in the molecule or polymerized ones (i.e., polymer coupler). The couplers may be 4-equivalent or 2-equivalent for a silver ion. The couplers may be colored couplers having a color correcting effect or couplers capable of releasing a development inhibitor with a course of development, that is, so-called DIR couplers.

Besides DIR couplers, colorless DIR coupling compounds whose coupling reaction products are colorless and that can release development inhibitors can also be included. Besides DIR couplers, compounds that will release development inhibitors with a cohurse of development may also be included in the photosensitive material.

To satisfy the characteristics required for the photosensitive material, of course, two or more of the above mentioned couplers may be present in the same layer or the same coupler may be added in two or more layers.

Various photographic addenda which can be used in the present invention are disclosed in, for example, *Research Disclosure,* No. 17643, pages 23–28 and No. 18716, pages 648–651 (incorporated herein by reference) as illustrated below.

| Example of Addenda | RD No. 17643 Page | RD No. 18716 Page |
|---|---|---|
| (1) Chemical sensitizers | 23 | 648 right column |
| (2) Speed-increasing compound | | 648 right column |
| (3) Spectral sensitizers and supersensitizers | 23–24 | 648 right column to 649 right column |
| (4) Antifoggants and stabilizers | 24–25 | 649 right column |
| (5) Light-absorbing material, filter dyes, scattering materials and ultraviolet absorbers | 25–26 | 649 right column to 650 right column |
| (6) Antistain agents | 25 right column | 650 left to right column |
| (7) Hardeners | 26 | 651 left column |
| (8) Vehicles and binding agents | 26 | 651 left column |

-continued

| Example of Addenda | RD No. 17643 Page | RD No. 18716 Page |
|---|---|---|
| (9) Plasticizers and lubricants | 27 | 650 right column |
| (10) Coating aids such as surfactants | 26–27 | 650 right column |
| (11) Agents for antistatic or conducting layers | 27 | 650 right column |

Suitable supports which can be used in the present invention are disclosed in, for example, ibid., No. 17643, page 28 and No. 18716, page 647 right column to 648 left column (incorporated herein by reference).

Generally, the treatment steps for a color reversal photosensitive material include basically the following steps:

Black-and-white development (first development),
Stopping,
Washing,
Reversing,
Washing,
Color development,
Stopping,
Washing,
Compensating bath,
Washing,
Bleaching,
Washing,
Fixing,
Washing,
Stabilizing, and
drying.

These steps may further include a prebath, a prehardening bath and a neutralizing bath. The washing steps respectively after the stopping, reversing, color development, and compensating bath can be omitted. Reexposure can be substituted for the reversing bath, or the reversing bath can be omitted by the addition of a fogging agent to the color developing bath. Further, the compensating bath can be omitted.

The black-and-white developer can use known developing agents such as dihydroxybenzenes (e.g., hydroquinone), 3-pyrazolidones (e.g., 1-phenyl-3-pyrazolidone), aminophenols (e.g., N-methyl-p-aminophenol), etc., that can be used alone or in combination.

The black-and-white developer can contain a silver halide solvent such as sodium sulfite, potassium thiocyanate, or thioethers, the preferred amount of these is at least 0.1 g and preferably at least 0.5 g per liter and the upper limit of the amount would be limited by the solubility. These can be used in combination.

In addition to the silver halide solvent, this developer can contain an antifoggant, i.e., a development restrainer, such as an organic antifoggant, a carbonate, a borate, a phosphate, a sulfite, a bromide, and an iodide. If desired, the developer may contain a water softener, a preservative such as hydroxylamine, an organic solvent such as diethylene glycol and benzyl alcohol, a development accelerator such as amines, polyethylene glycols, and quaternary ammonium salts, a dye forming coupler, a competing coupler, a fogging agent such as sodium boron hydride, an auxiliary developing agent such as 1-phenyl-3-pyrazolidone, a viscosity producer, a polycarboxylic acid type chelating agent as disclosed in U.S. Pat. No. 4,083,723, an antioxidant as disclosed in German Patent Application (OLS) No. 2,622,950, etc.

A color developer generally comprises an alkaline aqueous solution containing a color developing agent. The color developing agent may comprise a known primary aromatic amine developer such as phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfoamidoethylaniline, 4-amino-3-methyl-N-ethyl-N-β-methoxyethylaniline).

Other examples of color developing agents are disclosed in *Photographic Processing Chemistry,* edited by L. F. A. Mason, published by Focal Press (1966), pages 226–229, U.S. Pat. Nos. 2,193,015 and 2,592,364, Japanese Patent Application (OPI) No. 64933/73, etc.

In addition thereto, the additives mentioned with reference to black-and-white developers may also be included in the color developer.

The bleaching treatment may be carried out separately from or simultaneously with the fixing treatment. Examples of bleaching agents are compounds of polyvalent metals such as iron (III), cobalt (III), chromium (VI) and copper (II), peracids, quinones, and nitroso compounds. For example, the following can be used: ferricyanides; dichromates; organic complex salts of iron (III) or cobalt (III) such as complex salts of aminopolycarboxylic acids (for example, 1,3-diamino-2-propanoltetraacetic acid, ethylenediaminetetraacetic acid and nitrilotriacetic acid), citric acid, tartaric acid and malic acid with iron (III) or cobalt (III); persulfates and permanganates; and nitrosophenol. Potassium ferricyanide, sodium iron (III) ethylenediaminetetraacetate and ammonium iron (III) ethylenediaminetetraacetate are particularly useful. Iron (III) ethylenediaminetetraacetate complex salt is useful in an independent bleaching solution and also in a combined bleaching and fixing solution.

To a bleaching solution or a bleaching and fixing solution may be added various additives such as a bleaching accelerator described in U.S. Pat. Nos. 3,042,520 and 3,241,966, Japanese Patent Publication Nos. 8506/70 and 8836/70, etc., and a thiol compound described in Japanese Patent Application (OPI) No. 65732/78.

As a fixing solution there can be used a fixing solution having a composition that is generally used. As a fixing agent there can be used, in addition to a thiosulfate and a thiocyanate, an organic sulfur compound that can act as a fixing agent. The fixing solution can contain a water-soluble aluminum salt as a hardening agent.

The invention will now be further explained in greater detail with reference to the following examples, which are not meant to limit the invention.

Unless otherwise specified, all percents, ratios, etc., are by weight.

EXAMPLES

Color Photographic Materials A and B were prepared by applying the following first layer to the eighth layer onto each paper support whose both surfaces were laminated with a polyethylene. The constitution of the layers and the materials in the layers are given in the following:

| | | |
|---|---|---|
| Eighth Layer (protective layer) | Gelatin | 1,000 mg/m$^2$ |
| Seventh Layer (ultraviolet absorbing layer) | Gelatin | 1,500 mg/m$^2$ |
| | Ultraviolet absorber (*1) | 1,000 mg/m$^2$ |
| | Ultraviolet absorber solvent (*2) | 300 mg/m$^2$ |
| | Color mixing preventor (*3) | 80 mg/m$^2$ |
| Sixth Layer (blue-sensitive layer) | Silver bromoiodide emulsion (2.5 mol % silver iodide) | 350 mg Ag/m$^2$ |
| | Blue sensitizing dye (*4) | |
| | Gelatin | 1,500 mg/m$^2$ |
| | Yellow coupler (*5) | 600 mg/m$^2$ |
| | Coupler solvent (*2) | 150 mg/m$^2$ |
| Fifth Layer (yellow filter layer) | Yellow colloidal silver | 200 mg/m$^2$ |
| | Gelatin | 1,000 mg/m$^2$ |
| | Color mixing preventor (*6) | 60 mg/m$^2$ |
| | Color mixing preventor solvent (*7) | 240 mg/m$^2$ |
| Fourth Layer (green-sensitive layer) | Silver bromoiodide emulsion (3.5 mol % silver iodide) | 400 mg Ag/m$^2$ |
| | Green sensitizing dye (*8) | |
| | Gelatin | 1,400 mg/m$^2$ |
| | Magenta coupler (*9) | 300 mg/m$^2$ |
| | Discoloration Preventing Agent A (*10) | 100 mg/m$^2$ |
| | Discoloration Preventing Agent B (*11) | 100 mg/m$^2$ |
| | Discoloration Preventing Agent C (*12) | 40 mg/m$^2$ |
| | Coupler solvent (*13) | 300 mg/m$^2$ |
| Third Layer (intermediate layer) | Yellow colloidal silver | 20 mg/m$^2$ |
| | Gelatin | 1,000 mg/m$^2$ |
| | Discoloration preventing agent (*6) | 80 mg/m$^2$ |
| | Discoloration preventing agent solvent (*7) | 160 mg/m$^2$ |
| | Polymer latex (*14) | 400 mg/m$^2$ |
| Second Layer (red-sensitive layer) | Silver bromoiodide emulsion (5.3 mol % silver iodide) | 250 mg Ag/m$^2$ |
| | Red sensitizing dye (*15, 16) | |
| | Gelatin | 1,500 mg/m$^2$ |
| | Cyan coupler (*17) | 400 mg/m$^2$ |
| | Discoloration preventing agent (*18) | 200 mg/m$^2$ |
| | Coupler solvent (*19) | 80 mg/m$^2$ |
| First Layer (antihalation layer) | Black colloidal silver | 100 mg/m$^2$ |
| | Gelatin | 2,000 mg/m$^2$ |
| Support | Polyethylene laminated paper (polyethylene on the first layer side contains white pigment ($TiO_2$, etc.) and blue dye (ultramarine blue pigment, etc.)) | |

Color Photographic Materials C, D, E and F were prepared by applying the following first layer to the eleventh layer onto each of paper supports whose both surfaces were laminated with a polyethylene. The constitution of the layer is given in the following:

| | | |
|---|---|---|
| Eleventh Layer (protective layer) | Gelatin | 1,000 mg/m$^2$ |
| Tenth Layer (ultraviolet absorbing layer) | Gelatin | 1,500 mg/m$^2$ |
| | Ultraviolet absorbing agent (*1) | 1,000 mg/m$^2$ |

-continued

| | | |
|---|---|---|
| | Ultraviolet absorbing agent solvent (*2) | 300 mg/m$^2$ |
| | Color mixing preventor (*3) | 80 mg/m$^2$ |
| Ninth Layer (high speed blue-sensitive layer) | Silver bromoiodide emulsion (2.5 mol % silver iodide) | 200 mg Ag/m$^2$ |
| | Blue sensitizing dye (*4) | |
| | Gelatin | 1,000 mg/m$^2$ |
| | Yellow coupler (*5) | 400 mg/m$^2$ |
| | Coupler solvent (*2) | 100 mg/m$^2$ |
| Eighth Layer (low speed blue-sensitive layer) | Silver bromoiodide emulsion (2.5 mol % silver iodide) | 150 mg Ag/m$^2$ |
| | Blue sensitizing dye (*4) | |
| | Gelatin | 500 mg/m$^2$ |
| | Yellow coupler (*5) | 200 mg/m$^2$ |
| | Coupler solvent (*2) | 50 mg/m$^2$ |
| Seventh Layer (yellow filter layer) | Yellow colloidal silver | 200 mg/m$^2$ |
| | Gelatin | 1,000 mg/m$^2$ |
| | Color mixing preventor (*6) | 60 mg/m$^2$ |
| | Color mixing preventor solvent (*7) | 240 mg/m$^2$ |
| Sixth Layer (high speed green-sensitive layer) | Silver bromoiodide emulsion (2.5 mol % silver iodide) | 200 mg Ag/m$^2$ |
| | Green sensitizing dye (*8) | |
| | Gelatin | 700 mg/m$^2$ |
| | Magenta coupler (*9) | 150 mg/m$^2$ |
| | Discoloration Preventing Agent A (*10) | 50 mg/m$^2$ |
| | Discoloration Preventing Agent B (*11) | 50 mg/m$^2$ |
| | Discoloration Preventing Agent C (*12) | 20 mg/m$^2$ |
| | Coupler solvent (*13) | 150 mg/m$^2$ |
| Fifth Layer (low speed green-sensitive layer) | Silver bromoiodide emulsion (3.5 mol % silver iodide) | 200 mg Ag/m$^2$ |
| | Green sensitizing dye (*8) | |
| | Gelatin | 700 mg/m$^2$ |
| | Magenta coupler (*9) | 150 mg/m$^2$ |
| | Discoloration Preventing Agent A (*10) | 50 mg/m$^2$ |
| | Discoloration Preventing Agent B (*11) | 50 mg/m$^2$ |
| | Discoloration Preventing Agent C (*12) | 20 mg/m$^2$ |
| | Coupler solvent (*13) | 150 mg/m$^2$ |
| Fourth Layer (intermediate layer) | Yellow colloidal silver | 20 mg/m$^2$ |
| | Gelatin | 1,000 mg/m$^2$ |
| | Discoloration preventing agent (*6) | 80 mg/m$^2$ |
| | Discoloration preventing agent solvent (*7) | 160 mg/m$^2$ |
| | Polymer latex (*14) | 400 mg/m$^2$ |
| Third Layer (high speed red-sensitive | Silver bromoiodide emulsion (5.3 mol % silver iodide) | 250 mg Ag/m$^2$ |
| | Red sensitizing dye (*15, 16) | |
| | Gelatin | 500 mg/m$^2$ |
| | Cyan coupler (*17) | 100 mg/m$^2$ |
| | Discoloration preventing agent (*18) | 50 mg/m$^2$ |
| | Coupler solvent (*19) | 20 mg/m$^2$ |
| Second Layer (low speed red-sensitive layer) | Silver bromoiodide emulsion (5.2 mol % silver iodide) | 250 mg Ag/m$^2$ |
| | Red sensitizing dye (*15, 16) | |
| | Gelatin | 1,000 mg/m$^2$ |
| | Cyan coupler (*17) | 300 mg/m$^2$ |
| | Discoloration preventing agent (*18) | 150 mg/m$^2$ |
| | Coupler solvent (*19) | 60 mg/m$^2$ |
| First Layer (antihalation layer) | Black colloidal silver | 100 mg/m$^2$ |
| | Gelatin | 2,000 mg/m$^2$ |
| Support | Polyethylene laminated paper (polyethylene on the first layer side contains white pigment ($TiO_2$, etc.) and blue dye (ultramarine blue pigment, etc.)) | |

The materials marked with * in the above tables comprised the compounds listed below. These compounds were used in Photosensitive Materials A to F in common. The oil-soluble constituents such as couplers and discoloration preventing agents used in the layers were first dissolved in the coupler solvent given in the tables and auxiliary solvents such as ethyl acetate, etc., and were mixed with the gelatin solution in the presence of an emulsifier such as a sodium alkylbenzenesulfonate or the like, and the mixture was stirred mechanically, for example, by a mixer to be emulsified and was added to the coating liquid.

*1: 5-Chloro-2-(2-hydroxy-3-t-butyl-5-octyl)phenylbenzotriazole
*2: Trinonyl phosphate
*3: 2,5-Disecondary-octylhydroquinone
*4: Triethylammonium 3-[2-(3-benzylrhodanine-5-ilidene)-3-benzoxazoryl]propane sulfonate
*5: α-Pivaloyl-α-(2,4-dioxo-1-benzyl-5-ethoxyhydantoin-3-yl)-2-chloro-5-[α-(2,4-di-t-amylphenoxy)-butanamido]acetanilide
*6: 2,5-Ditertiary-octylhydroquinone
*7: Phosphoric acid-o-cresyl ester
*8: 5,5'-Diphenyl-9-ethyl-3,3'-disulfopropyloxycarbocyanine sodium salt
*9: 1-(2,4,6-Trichlorophenyl)-3-(2-chloro-5-tetradecanamido)anilino-2-pyrazolin-5-one
*10: 3,3,3',3'-Tetramethyl-5,6,5',6'-tetrapropoxy-1,1'-bisspiroindane
*11: Di(2-hydroxy-3-t-butyl-5-methylphenyl)methane
*12: 2,5-Ditertiary-hexylhydroquinone
*13: Trioctyl phosphate
*14: Polyethylacrylate
*15: Triethylammonium 3-[2-{2-[3-(3-sulfonatopropyl)-naphtho[1,2-d]thiazoline-2-ilidenemethyl]-1-butenyl}-3-naphtho[1,2-d]thiazolino]propanesulfonate
*16: 5,5'-Dichloro-3,3'-di(3-sulfobutyl)-9-ethylthiacarbocyanine sodium salt
*17: 2-[α-(2,4-di-t-acylphenoxy)butanamido]-4,6-dichloro-5-methylphenol
*18: 2-(2-Hydroxy-3-sec-butyl-5-t-butylphenyl)benzotriazole
*19: Dioctylphthalate.

In addition to these, each coating liquid contains a surface active agent, a thickening agent and a hardening agent.

The silver bromoiodide emulsion used in each color sensitive layer was prepared as follows and was used in Photosensitive Materials A to F as shown in Table 1.

(Em 1-1) and (Em 1-2)

Grains were formed in a usual manner by the two step single jet method. The mixing temperature was 60° C., and the adding time was such that first stage/second stage=20 min/20 min for (Em 1-1) and the mixing temperature was 63° C., and the adding time was such that first stage/second stage=15 min/20 min for (Em 1-2).

(Em 1-3), (Em-3) and (Em-b 5)

The grain formation was carried out by the double jet method at 65° C. for 40 min for (Em 1-3), at 50° C. for 40 min for (Em-3) and at 55° C. for 40 min for (Em-5). After washing, gold sensitization and/or sulfur sensitization suitable for respective cases was carried out.

The following (Em-2) and (Em-3) are examples of green-sensitive emulsion layer.

| (Em-2) | | |
|---|---|---|
| Solution I: | Gelatin | 30 g |
| | $H_2O$ | 440 g |
| | Potassium Bromide | 20 g |
| Solution II: | Silver Nitrate | 200 g |
| | $H_2O$ | 900 cc |
| Solution III: | Potassium Bromide | 140 g |
| | Potassium Iodide | 6.8 g |
| | $H_2O$ | 900 ml |

Before precipitating the silver halide, Compound (I-12) (that is, a silver halide solvent represented by the general formula (I)) in an amount of $2\times10^{-3}$ mol was added to Solution I, Solution I was kept at 65° C., then Solution II and Solution III were added at the same time at 65° C. over a period of 60 min with vigorous stirring to prepare a silver bromoiodide emulsion (whose silver iodide content was 3.5 mol%) wherein the average grain diameter was about 0.3 micron, cooling and desalting were carried out and gelatin was added to bring the volume to 1,000 cc. Then, the preparation was subjected to sulfur sensitization and gold sensitization as described in U.S. Pat. No. 2,399,083 to prepare an emulsion.

| (Em-4) | | |
|---|---|---|
| Solution I: | Gelatin | 30 g |
| | $H_2O$ | 440 cc |
| | Potassium Bromide | 0.03 g |
| Solution II: | Silver Nitrate | 200 g |
| | $H_2O$ | 900 cc |
| Solution III: | Potassium Bromide | 140 g |
| | Potassium Iodide | 6.8 g |
| | $H_2O$ | 900 cc |

Solution I was kept at 65° C. and Solution II was added over a period of 50 min. During the addition, Solution III was added at the same time to keep the electric potential at 34 mV, so that a silver bromoiodide emulsion (containing 3.5 mol% silver iodide) wherein the average grain diameter was about 0.3 micron was prepared, cooling and desalting were carried out, and gelatin was added to bring the volume to 1,000 cc. In a usual manner, the gold and sulfur sensitizations were carried out.

The samples obtained were exposed to light using a continuous wedge having silver deposition, and were subjected to the following color reversal treatment.

| Treatment Steps | | |
|---|---|---|
| First Development (blach-and-white development) | 38° C. | 75 sec |
| Washing | 38° C. | 90 sec |
| Reversal Exposure | | 100 lux |
| Color Development | 38° C. | 135 sec |
| Washing | 38° C. | 45 sec |
| Bleach-Fixing | 38° C. | 120 sec |
| Washing | 38° C. | 135 sec |
| Drying | | |

The treating solutions used had the following compositions.

| First Developer: | |
|---|---|
| Hexasodium Nitrilo-N,N,N—trimethylene-phosphonate | 3.0 g |
| Anhydrous Potassium Sulfite | 20.0 g |

-continued

| | |
|---|---|
| Sodium Thiocyanate | 1.2 g |
| 1-Phenyl-4-methyl-4-hydroxymethyl-3-pyrazolidone | 2.0 g |
| Anhydrous Sodium Carbonate | 30.0 g |
| Potassium Hydroquinonemonosulfonate | 30.0 g |
| Potassium Bromide | 2.5 g |
| Potassium Iodide (0.1% aq. soln.) | 2 ml |
| Water to make | 1,000 ml |
| The pH was adjusted to 9.7 | |
| Color Developer: | |
| Benzyl Alcohol | 15.0 ml |
| Ethylene Glycol | 12.0 ml |
| Hexasodium Nitrilo-N,N,N—trimethylene-phosphonate | 3.0 g |
| Potassium Carbonate | 26.0 g |
| Sodium Sulfite | 2.0 g |
| 1,2-Di(2'-hydroxydiethyl)mercaptoethane | 0.6 g |
| Hydroxylamine Sulfate | 3.0 g |
| 3-Methyl-4-amino-N—ethyl-N—β-methane-sulfonamidoethylanilinesulfonate | 5.0 g |
| Sodium Bromide | 0.5 g |
| Potassium Iodide (0.1% aq. soln.) | 0.5 ml |
| Water to make | 1,000 ml |
| The pH was adjusted to 10.5 | |
| Bleach-Fixing Solution: | |
| Ammonium Iron (III) Ethylenediamine-N,N,N',N'—tetraacetate (dihydrate) | 80.0 g |
| Sodium Metabisulfite | 15.0 g |
| Ammonium Thiosulfate (58% aq. soln.) | 126.6 ml |
| 2-Mercapto-1,3,5-triazole | 0.20 g |
| Water to make | 1,000 ml |
| The pH was adjusted to 6.5 | |

Figure 2:
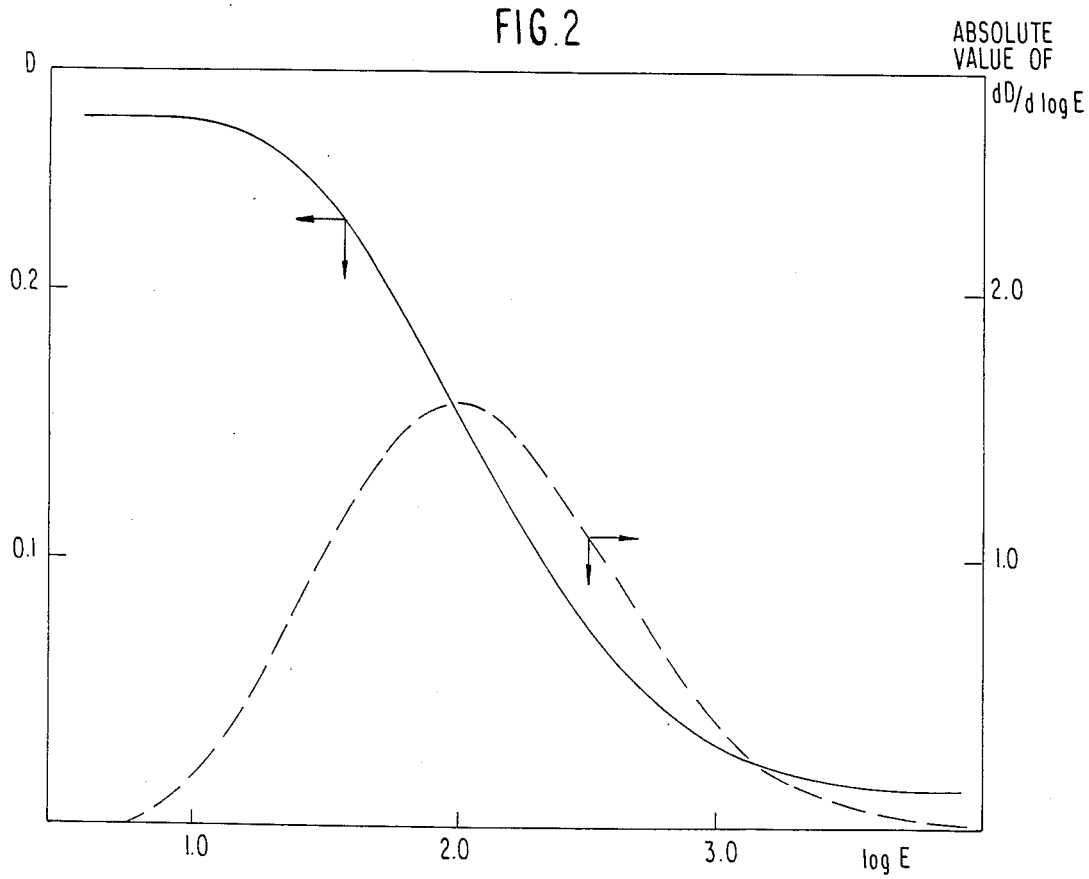
FIG. 2 and FIG. 3 each shows a D-log E curve (solid line) and a dD/d log E-log E curve (broken line) for the green-sensitive emulsion layer of Photosensitive Materials A and F, respectively, in Example.

After the treatment, the dye densities of yellow, magenta and cyan of the dye image was determined in the manner as described above, and was plotted against the log E's of the exposures, so that characteristic curves (solid lines) for the blue-sensitive layer, green-sensitive and red-sensitive layers were obtained. From these curves (D-log E curves), dD/dlog E values (point-gammas) were determined and were plotted against the log E's in the same charts as shown at dotted lines. With respect to Photosensitive Materials A and F, as representatives, the characteristic curves and the point-gamma-to-log E curves of the green-sensitive layer obtained from their magenta densities are shown in FIG. 2 (Photosensitive Material A) and FIG. 3 (Photosensitive Material F).

With respect to Photosensitive Materials A to F, emulsions used and the characteristic values related to the present invention that were obtained from the characteristic curves of the green-sensitive layers are given in Table 1.

In Table 1, Photosensitive Materials B, D and F in the Examples are according to the present invention, while Photosensitive Materials A, C and E are not according to the present invention.

TABLE 1

| Photosensitive Material | A | B | C | D | E | F |
|---|---|---|---|---|---|---|
| Constitution of each color sensitive layer | 1 layer | 1 layer | 2 layers | 2 layers | 2 layers | 2 layers |
| Emulsion of high speed sensitive layer | Polydisperse emulsion (Em 1-1) | Polydisperse emulsion (Em 1-2), Monodisperse emulsion (Em-2) | Polydisperse emulsion (Em 1-2) | Polydisperse emulsion (Em 1-2) | Polydisperse emulsion (Em 1-3) | Polydisperse emulsion (Em 1-3) |
| Emulsion of low speed sensitive layer | — | — | Polydisperse emulsion (Em-3) | Monodisperse emulsion (Em-4) | Polydisperse emulsion (Em-5), Monodisperse emulsion (Em-3) | Polydisperse emulsion (Em-5), Monodisperse emulsion (Em-2) |
| Average point-gamma in exposure range corresponding to D = 0.8 ~ 1.8 | 1.44 | 1.25 | 1.48 | 1.24 | 1.35 | 1.20 |
| Maximum point-gamma in the same exposure range | 1.55 (7.6%)* | 1.33 (6.4%) | 1.58 (6.8%) | 1.30 (4.8%) | 1.50 (11.1%) | 1.22 (1.7%) |
| Minimum point-gamma in the same exposure range | 1.17 (18.8%) | 1.15 (8%) | 1.00 (32.4%) | 1.17 (6.6%) | 1.14 (15.6%) | 1.17 (2.5%) |
| Lowest value of point-gamma in exposure range corresponding to D = 0.2 ~ 0.3 | 0.18 | 0.39 | 0.18 | 0.42 | 0.25 | 0.34 |
| | Comparison | Invention | Comparison | Invention | Comparison | Invention |

*The values in parentheses are the fluctuation width from the average values.

In Table 1 above, a silver amount ratio of (Em 1-2)/(Em-2) in Photosensitive Material B is 80/20; a silver amount ratio of (Em-5)/(Em-3) in Photosensitive Material E is 60/40; and a silver amount ratio of (Em-5)/(Em-2) in Photosensitive Material F is 60/40.

Figure 3:
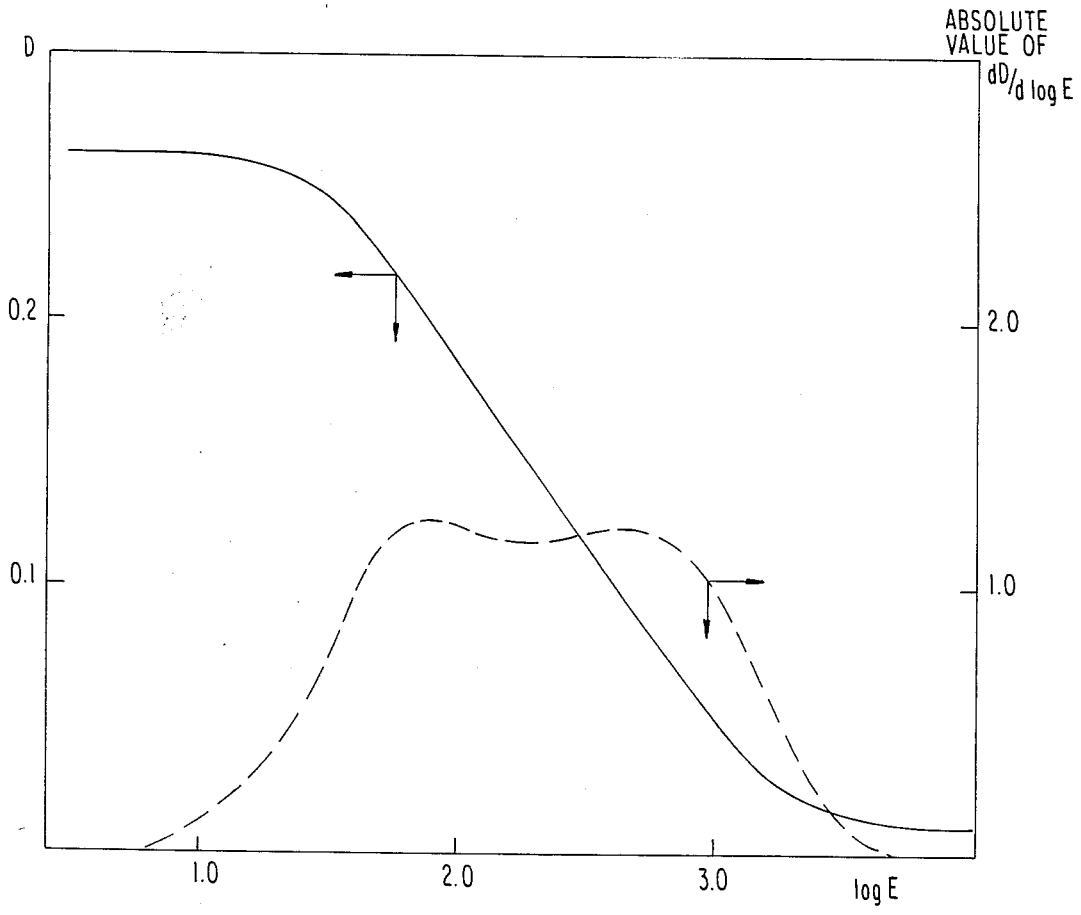

As will be understood by comparing FIG. 2 and FIG. 3, the characteristic curve and the point-gamma-log E curve of Photosensitive Material F according to the present invention can be distinguished from those of Photosensitive Material A that fall outside of the present invention.

To compare the tone reproducibilities using these photosensitive materials for a transmission original and a reflection original, printing was effected using the same transmission original and the same reflection original. As a transmission original there was used a color reversal film for forming a color slide [Fujichrome 100 Professional D (Daylight type) produced by Fuji Photo Film Co., Ltd.] and as a reflection original there was used a color print obtained by using Fuji Color Paper type 08 (produced by Fuji Photo Film Co., Ltd.).

The densities in certain linear sections of the originals and at points in certain linear sections on the corresponding prints were determined and the values of typical points are given in Tables 2 and 3.

Table 2 shows the results of prints from the transmission original. Densities of points (a) to (h) where measurements were carried out on the transmission original and the densities of the prints corresponding to said points (a) to (h) when printing was carried out to Photosensitive Materials A to F are given in Table 2.

These points will correspond in practice to the following points that are given for reference:

(a): Black background
(b): Gray chart (1)
(c): Gray chart (2)
(d): Gray chart (3)
(e): Shadowed part of face
(f): Highlight part of face
(g): Shadowed part of shirt
(h): Highlight part of shirt It is required that a reversal color print can reproduce faithfully the tone of the original as far as possible. Therefore, it is preferable that the density of the original, particularly the difference in density, is reproduced faithfully. Now, using the values of the densities of the magenta in Table 2 to compare Photosensitive Materials A and F, discussion will be given below.

(1) The density at the point (h) corresponds to the density of 0.14 of the original, Photosensitive Material A reproduced it as a density of 0.26 while Photosensitive Material F reproduced it as a density of 0.16, Photosensitive Material F according to the present invention being good at the most highlight part.

(2) The difference of densities of the original at the points (g) and (h) is 0.19, that of Photosensitive Material A is 0.09 and that of Photosensitive Material F is 0.17, so that it can be understood that Photosensitive Material F according to the present invention has reproducibility more faithful to the original. In practice, in Comparative Example A, the shade of a shite shirt could not be distinguished and its texture was lessened, while in Photosensitive Material F according to the present invention, the difference of densities was close to that of the original and the texture would not be lessened.

(3) With respect to the difference of densities at the points (e) and (f), similarly to term (2), Photosensitive Material F according to the invention is excellent in tone reproducibility.

(4) At the points (b), (c) and (d), with respect to the difference of densities of the points, in comparison to Comparative Example A, Photosensitive Material F according to the present invention is faithful to the difference of the densities of the original.

The same can be found in all the yellow densities, the magenta densities and the cyan densities of Photosensitive Materials A to F with respect to the comparison between the present invention and Comparative Examples.

Therefore, it can be seen that the present invention provides a print excellent in tone reproducibility for a transmission original.

Table 3 shows the measured values of the densities of prints obtained from a reflection original using Photosensitive Materials A to F and the measured values of the densities of the reflection original.

Reproducibility of the magenta density for an original will now be discussed with respect to Photosensitive Materials A to F.

(1) At the point (a), the value of the density of the original is 2,6, the density of Photosensitive Material F according to the present invention is 2.58 and the density of Photosensitive Material A is 2.40. It will be understood that the density of Photosensitive MaterialF according to the present invention is close to the density of the original.

(2) At the points (g) and (h), the difference is higher in the case of Photosensitive Material F than in the case of Photosensitive Material A, and it will be understood that Photosensitive Material F is close to the density of the original.

(3) The same results were obtained with respect to the difference at the points (e) and (f).

(4) The value of the density at the point (h) is 0.24 for Photosensitive Material F according to the present invention, which is closer to the value of 0.24 of the original than 0.27 for Photosensitive Material A.

The same can be found in all the yellow densities, the magenta densities and the cyan densities of Photosensitive Materials A to F with respect to the comparison between the present invention and Comparative Examples.

Therefore, according to the present invention, it will be understood that excellent tone reproduction for a reflection original and reproduction in a wide range of density become possible. (For example, in Photosensitive Material A, it is possible to reproduce high density by decreasing the exposure when the printing is carried out, but since the density at the highlight part will be increased, it will not be preferred in that the reproduction of the highlight part becomes worsened further.)

As described above, it will be understood from the results shown in Tables 2 and 3 that the photosensitive materials according to the present invention exhibit more excellent gradation reproducibility irrespective of whether the original is a transmission original or a reflection original.

TABLE 2

| | Tone Reproduction When Printing Was Effected from a Transmission Original | | | | | | | |
|---|---|---|---|---|---|---|---|---|
| | (a) | (b) | (c) | (d) | (e) | (f) | (g) | (h) |
| | Yellow Density | | | | | | | |
| Original | 2.75 | 1.60 | 1.20 | 0.90 | 0.63 | 0.40 | 0.25 | 0.14 |
| Photosensitive Material A | 2.54 | 1.69 | 1.28 | 0.81 | 0.59 | 0.42 | 0.27 | 0.23 |
| Photosensitive Material B | 2.59 | 1.61 | 1.28 | 0.87 | 0.62 | 0.43 | 0.23 | 0.15 |
| Photosensitive Material C | 2.58 | 1.73 | 1.35 | 0.82 | 0.53 | 0.43 | 0.26 | 0.23 |
| Photosensitive Material D | 2.59 | 1.59 | 1.25 | 0.89 | 0.63 | 0.45 | 0.25 | 0.14 |
| Photosensitive Material E | 2.62 | 1.65 | 1.30 | 0.90 | 0.58 | 0.43 | 0.26 | 0.22 |
| Photosensitive Material F | 2.63 | 1.55 | 1.18 | 0.86 | 0.65 | 0.41 | 0.26 | 0.15 |
| | Magenta Density | | | | | | | |
| Original | 2.81 | 1.75 | 1.33 | 1.04 | 0.67 | 0.42 | 0.33 | 0.14 |
| Photosensitive Material A | 2.64 | 1.91 | 1.43 | 0.96 | 0.60 | 0.43 | 0.35 | 0.26 |
| Photosensitive Material B | 2.70 | 1.85 | 1.35 | 1.07 | 0.65 | 0.43 | 0.34 | 0.18 |
| Photosensitive Material C | 2.65 | 1.92 | 1.44 | 0.97 | 0.57 | 0.42 | 0.34 | 0.18 |
| Photosensitive Material D | 2.65 | 1.81 | 1.30 | 1.05 | 0.63 | 0.41 | 0.35 | 0.16 |
| Photosensitive Material E | 2.63 | 1.78 | 1.40 | 1.05 | 0.58 | 0.40 | 0.32 | 0.19 |
| Photosensitive Material F | 2.64 | 1.72 | 1.34 | 1.01 | 0.65 | 0.40 | 0.33 | 0.16 |
| | Cyan Density | | | | | | | |

TABLE 2-continued

| | Tone Reproduction When Printing Was Effected from a Transmission Original | | | | | | | |
|---|---|---|---|---|---|---|---|---|
| | (a) | (b) | (c) | (d) | (e) | (f) | (g) | (h) |
| Original | 2.80 | 1.81 | 1.38 | 1.10 | 0.42 | 0.28 | 0.30 | 0.12 |
| Photo-sensitive Material A | 2.70 | 1.95 | 1.44 | 0.97 | 0.36 | 0.29 | 0.32 | 0.22 |
| Photo-sensitive Material B | 2.71 | 1.80 | 1.35 | 1.13 | 0.40 | 0.28 | 0.30 | 0.18 |
| Photo-sensitive Material C | 2.76 | 2.00 | 1.38 | 1.08 | 0.38 | 0.31 | 0.32 | 0.23 |
| Photo-sensitive Material D | 2.76 | 1.78 | 1.38 | 1.06 | 0.39 | 0.28 | 0.30 | 0.20 |
| Photo-sensitive Material E | 2.75 | 2.05 | 1.51 | 0.96 | 0.39 | 0.32 | 0.33 | 0.24 |
| Photo-sensitive Material F | 2.76 | 1.74 | 1.34 | 1.04 | 0.38 | 0.27 | 0.30 | 0.18 |

TABLE 3

| | Tone Reproduction When Printing Was Effected from a Reflection Original | | | | | |
|---|---|---|---|---|---|---|
| | (a) | (b) | (e) | (f) | (g) | (h) |
| | Yellow Density | | | | | |
| Original | 2.63 | 2.23 | 0.61 | 0.38 | 0.25 | 0.20 |
| Photosensitive Material A | 2.44 | 2.10 | 0.58 | 0.35 | 0.24 | 0.21 |
| Photosensitive Material B | 2.56 | 2.25 | 0.65 | 0.38 | 0.28 | 0.22 |
| Photosensitive Material C | 2.48 | 2.13 | 0.54 | 0.41 | 0.23 | 0.22 |
| Photosensitive Material D | 2.59 | 2.20 | 0.60 | 0.39 | 0.25 | 0.21 |
| Photosensitive Material E | 2.44 | 2.10 | 0.58 | 0.38 | 0.22 | 0.23 |
| Photosensitive Material F | 2.54 | 2.18 | 0.60 | 0.38 | 0.25 | 0.21 |
| | Matenta Density | | | | | |
| Original | 2.63 | 2.23 | 0.60 | 0.41 | 0.32 | 0.24 |
| Photosensitive Material A | 2.40 | 2.15 | 0.55 | 0.32 | 0.29 | 0.27 |
| Photosensitive Material B | 2.54 | 2.23 | 0.61 | 0.43 | 0.34 | 0.25 |
| Photosensitive Material C | 2.41 | 2.18 | 0.54 | 0.33 | 0.28 | 0.26 |
| Photosensitive Material D | 2.55 | 2.19 | 0.63 | 0.42 | 0.33 | 0.24 |
| Photosensitive Material E | 2.48 | 2.13 | 0.59 | 0.34 | 0.28 | 0.27 |
| Photosensitive Material F | 2.58 | 2.20 | 0.63 | 0.38 | 0.35 | 0.24 |
| | Cyan Density | | | | | |
| Original | 2.60 | 2.31 | 0.33 | 0.23 | 0.29 | 0.23 |
| Photosensitive Material A | 2.45 | 2.21 | 0.28 | 0.27 | 0.27 | 0.26 |
| Photosensitive Material B | 2.58 | 2.32 | 0.34 | 0.25 | 0.32 | 0.24 |
| Photosensitive Material C | 2.50 | 2.20 | 0.31 | 0.27 | 0.29 | 0.27 |
| Photosensitive Material D | 2.60 | 2.35 | 0.30 | 0.25 | 0.30 | 0.25 |
| Photosensitive Material E | 2.49 | 2.18 | 0.27 | 0.25 | 0.25 | 0.24 |
| Photosensitive Material F | 2.54 | 2.30 | 0.32 | 0.25 | 0.31 | 0.24 |

While the invention has been described in detail and with reference to specific embodiments thereof, it will be apparent to one skilled in the art that various changes and modifications can be made therein without departing from the spirit and scope thereof.

What is claimed is:

1. A silver halide color reversal reflection print photosensitive material having at least one blue-sensitive layer, at least one green-sensitive layer and at least one red-sensitive layer on a support, wherein in all the characteristic curves of said color sensitive layers, the fluctuation width of the point-gammas at each of points within the exposure range corresponding to a developed color density of from 1.8 to 0.8 is within ±15% of the average value of the point-gammas in said exposure range, and the absolute value of the point-gamma at each of points within the exposure range corresponding to a developed color density of from 0.3 to 0.2 is 0.3 or more, at least one of the color-sensitive layers comprising two or more silver halide emulsion layers having different sensitivities with respect to each other, in which the emulsion layer having the lowest sensitivity is a monodispersed emulsion layer.

2. A silver halide color reversal reflection print photosensitive material as claimed in claim 1, wherein the monodispersed emulsion in the monodispersed emulsion layer is an emulsion in which the grain size of 95% or more of the silver halide grains falls within the average grain size ±30%.

3. A silver halide color reversal reflection print photosensitive material as claimed in claim 2, characterized in that said lowest sensitive silver halide emulsion is a silver halide emulsion prepared by a controlled double jet method in which a soluble silver salt and a soluble halide are reacted with keeping the pAg in the liquid phase in which a silver halide is formed constant.

4. A silver halide color reversal reflection print photosensitive material as claimed in claim 2, characterized in that said lowest sensitive silver halide emulsion is a silver halide emulsion prepared using a silver halide solvent during grain formation.

5. A silver halide color reversal reflection print photosensitive material as claimed in claim 4, characterized in that said silver halide solvent is ammonia, a thiocyanate salt, a thioether compound, a thione compound or an amine compound.

6. A silver halide color reversal reflection print photosensitive material as claimed in claim 4, characterized in that said silver halide solvent is a tetra-substituted thiourea silver halide solvent having the following general formula (I):

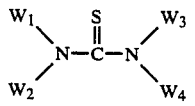

(I)

wherein $W_1$, $W_2$, $W_3$ and $W_4$ may be the same or different and each represents a substituted or unsubstituted alkyl group, an alkenyl group or a substituted or unsubstituted aryl group, and the sum of the carbon atoms of $W_1$, $W_2$, $W_3$ and $W_4$ is 30 or less, which alkyl group may be linear or branched, or $W_1$ and $W_2$, $W_2$ and $W_3$ or $W_3$ and $W_4$ may be combined to form a 5- or 6-membered heterocyclic ring.

7. A silver halide color reversal reflection print photosensitive material as claimed in claim 4, characterized in that said silver halide solvent is a thioether compound having the following general formula (IIA) or (IIB):

$$Q-[(CH_2)_r-CH_2-S-(CH_2)_2-X'-(R)_p-(CH_2)_2-(R')_q-S-CH_2-(CH_2)_m-Z']_n \quad \text{(IIA)}$$

$$Q-(CH_2)_m-CH_2-S-(CH_2)_n-S-CH_2-(CH_2)_r-Z' \quad \text{(IIB)}$$

wherein r and m are independently 0 or an integer of from 1 to 4; n is an integer of from 1 to 4; p and q are independently 0 or an integer of from 1 to 3; X' represents an oxygen atom, a sulfur atom, $$-\overset{O}{\overset{\|}{C}}NH-,\ -\overset{O}{\overset{\|}{C}}-\ \text{or}\ -\overset{O}{\overset{\|}{C}}-O-;$$

R and R' represents independently a $-CH_2-CH_2-O-$ or $-O-CH_2-CH_2-$ group; and Q and Z' represents independently $$-\overset{O}{\overset{\|}{C}}NH_2,\ -OR''\ \text{or}\ -\overset{O}{\overset{\|}{C}}-OR''$$

wherein R'' represents a hydrogen atom or an alkyl group having 1 to 5 carbon atoms, or Q and Z' may represent together a substituent represented by X' defined above to form a cyclic compound.

8. A silver halide color reversal reflection print photosensitive material as claimed in claim 7, characterized in that said silver halide solvent is a thioether compound having one of the following general formulae (IIC) to (IIH):

$$HO-R^3-(S-R^5)_r-S-R^3-OH \quad \text{(IIC)}$$

$$(HO-R^3-S-R^3-O-R^5-)_2 \quad \text{(IID)}$$

$$(R^4-O-R^3-S-R^3-\overset{O}{\overset{\|}{C}}-NH-R^5-)_2 \quad \text{(IIE)}$$

$$(R^4-O-R^3-S-R^3-)_2S \quad \text{(IIF)}$$

$$(R^4-NH-\overset{O}{\overset{\|}{C}}-R^3-S-R^3-)_2O \quad \text{(IIG)}$$

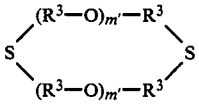

(IIH)

wherein r' represents 0 or an integer of from 0 to 3; m' represents an integer of 1 or 2; $R^3$ and $R^5$ each represents an alkylene group having 1 to 5 carbon atoms; and $R^4$ represents an alkyl group having 1 to 5 carbon atoms.

9. A silver halide color reversal reflection print photosensitive material as claimed in claim 4, characterized in that said silver halide solvent is a compound having a general formula (III):

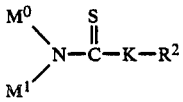

(III)

wherein K represents a sulfur atom or an oxygen atom; $M^0$ and $M^1$ may be the same or different and each represents an unsubstituted or substituted aliphatic group having 1 to 4 carbon atoms, an unsubstituted or substituted aryl group, a heterocyclic ring residue or an amino group; $M^0$ and $M^1$ may be combined together to form a 5- or 6-membered heterocyclic ring; $M^2$ represents an unsubstituted or substituted aliphatic group having 1 to 4 carbon atoms or an unsubstituted or substituted aryl group; and $M^1$ and $M^2$ may be combined together to form a 5- or 6-membered heterocyclic ring.

10. A silver halide color reversal reflection print photsensitive material as claimed in claim 9, characterized in that said silver halide solvent is a compound having the general formula (III'):

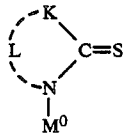

(III')

wherein L represents a group of atoms required to complete a heterocyclic ring and K and $M^0$ have the same meaning as defined for the formula (III).

11. A silver halide color reversal reflection print photosensitive material as claimed in claim 4, characterized in that the amount of the sileer halide solvent used is $10^{-5}$ to $2.5\times10^{-2}$ mol per mol of silver halide.

12. A silver halide color reversal reflection print photosensitive material as claimed in claim 1, which provides a D-log E curve showing substantial linearity between 1.8 and 0.8 with respect to developed color density and which has a sharp cut at the toe portion of the D-log E curve.

* * * * *